US005673761A

United States Patent [19]

Berner

[11] Patent Number: 5,673,761

[45] Date of Patent: Oct. 7, 1997

[54] ICE AUGER APPARATUS

[76] Inventor: John M. Berner, 4927 St. Croix Ave., Golden Valley, Minn. 55422

[21] Appl. No.: 510,748

[22] Filed: Aug. 3, 1995

[51] Int. Cl.[6] ..... E21B 10/44

[52] U.S. Cl. ..... 175/18

[58] Field of Search ..... 175/18, 220, 325.1, 175/325.6, 170; 173/162.2, 170, 164; 294/137, 141

[56] References Cited

U.S. PATENT DOCUMENTS

| | | | |
|---|---|---|---|
| 1,294,098 | 2/1919 | Hardtke | 175/170 X |
| 2,846,192 | 8/1958 | Ostling | 175/18 |
| 3,032,126 | 5/1962 | Rexine | 175/18 |
| 3,602,321 | 8/1971 | Kortschaga | 175/18 |
| 3,662,844 | 5/1972 | Baker | 175/18 |
| 4,971,161 | 11/1990 | Godell | 175/18 |
| 5,330,014 | 7/1994 | Wagner | 175/18 |

OTHER PUBLICATIONS

Computer printout of Jun. 12, 1995 Dialog database search for patents referring to Ice Auger Handles/Guards.

*Primary Examiner*—William P. Neuder

*Attorney, Agent, or Firm*—Palmatier, Sjoquist, Helget & Voigt, P.A.

[57] ABSTRACT

Disclosed is a device for boring holes in ice having a vertical boring position and a horizontal carrying position. The device is comprised of a drive unit with an output, a rotatable shank portion and auger portion coupled to the output. A non-driven grasping portion is connected to the drive unit and configured such that the device has a balance point at the grasping portion whereby the device may be carried in a balanced horizontal position with one hand. In a preferred embodiment a hollow cylindrical portion with a flange attaches to the drive unit and the shank portion extends through the cylindrical portion and is coupled to the out in the cylindrical portion. The grasping portion may either be the cylindrical portion or a separate bar portion attached to the cylindrical portions.

22 Claims, 4 Drawing Sheets

ICE AUGER APPARATUS

BACKGROUND OF THE INVENTION

Portable powered ice augers are utilized for boring holes in ice on bodies of water for fishing or other purposes. Such augers have a drive unit typically comprised of an internal combustion engine, a gear box, and a centrifugal clutch. The drive unit has an output with a coupling connecting the drive unit to a downwardly extending rotatable driven portion comprised of a shank portion and an auger portion. Such portable augers have handles attached to the drive unit for controlling and stabilizing the ice auger during the vertical cutting operation in the ice. The internal combustion engine utilizes a throttle controlled by a throttle lever which may be attached to one of the handles. Such ice augers are typically carried with one hand in a horizontal position by grasping the shank portion at the device's balance point. In that such devices are used in the winter the user will typically be wearing gloves. With any moisture present, the glove on the hand grasping the shank portion may freeze to said shank portion. The ice auger may be idling when carried and if the shank portion and auger start to rotate with the glove frozen to the shank, significant injuries may be incurred. Another problem is that the coupling may have catch points such as a protruding connecting pin that can entangle the glove or other wearing apparel when rotated.

An ice auger is needed which allows the auger to be carried in a balanced one handed horizontal position without grasping the shank portion. Moreover, an ice auger is needed that provides a guard over the coupling.

SUMMARY OF THE INVENTION

Disclosed is a device for boring holes in ice. The device having a vertical boring position and a horizontal carrying position. The device is comprised of a drive unit with an output, a driven axially aligned shank portion and an auger portion coupled to the output. A non-driven grasping portion is coupled to the drive unit. The device has a balance point at the grasping portion whereby the device may be carried in a balanced horizontal position with one hand. In a preferred embodiment a hollow cylindrical portion with a flange attaches to the drive unit and the shank portion extends through the cylindrical portion. The grasping portion may either be the cylindrical portion or a separate bar portion attached to the cylindrical portion.

An advantage and feature of the invention is that the grasping portion also functions as a guard to protect the operator or others from the rotating shank portion of the ice auger device.

An additional advantage and feature of the invention is that the cylindrical portion with the flanges and grasping portion may be retro-fitted onto existing ice augers.

An additional advantage and feature of the invention is that the grasping portion may be configured as a handle extending parallel to the shank portion and positioned on a particular side of the device allowing the ice auger device to always have the same orientation, such as the gas tank or throttle facing upwardly, when the ice auger is set down.

An additional advantage and feature of the invention is that the grasping portion may be formed as part of the lower casing portion of the power unit, such as part of the centrifugal clutch housing or gear reducer housing.

Another advantage and feature of the invention is that the grasping portion may be configured to be elongate such that when the ice auger's balance point shifts with accumulated ice on the auger portion the balance point is still located on the grasping portion.

Another advantage and feature of the invention is that the grasping portion may be embodied as part of an elongate tubular shield extending from the power unit and providing a bearing and coupling positioned at the distal end of the shank portion. The coupling so positioned reduces the overall length of the device when uncoupled and thus allows storage and shipment in shorter areas or containers. This can result in lower shipping and packaging costs. Moreover, such distal positioning of the bearing lessens the loading on said bearing thereby extending the bearing life or reducing the bearing's loading requirements.

A further advantage and feature of the invention is that the grasping portion may be spaced outwardly from the shank portion to be within the diameter of the auger whereby the depth of the hole which may be drilled with said auger is not restricted by the grasping portion.

DETAILED DESCRIPTION OF THE PREFERRED EMBODIMENTS

Figure 1:
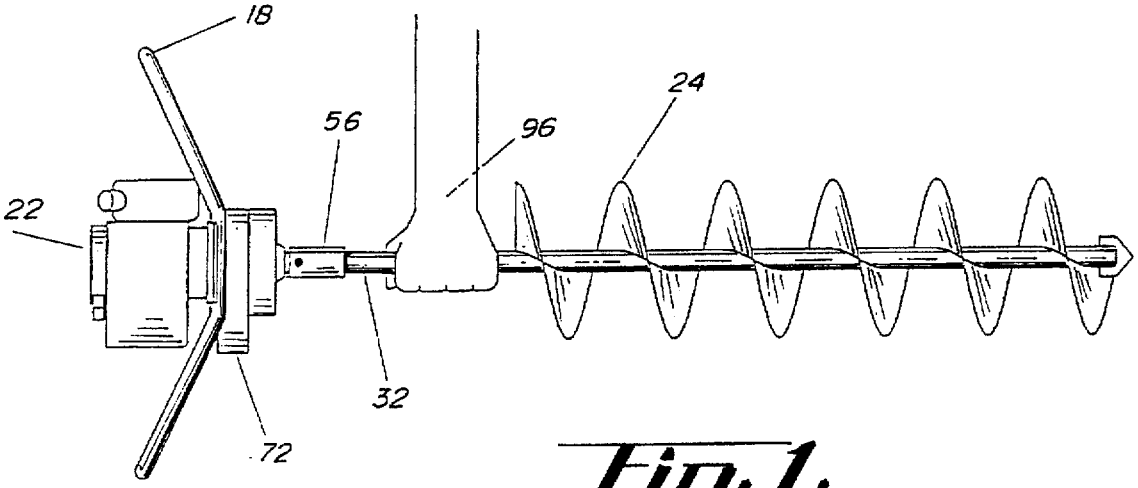
Fig. 1. PRIOR ART
FIG. 1 is an elevational view of a prior art ice auger being held by the shank portion in a horizontal carrying position.
Figure 2:
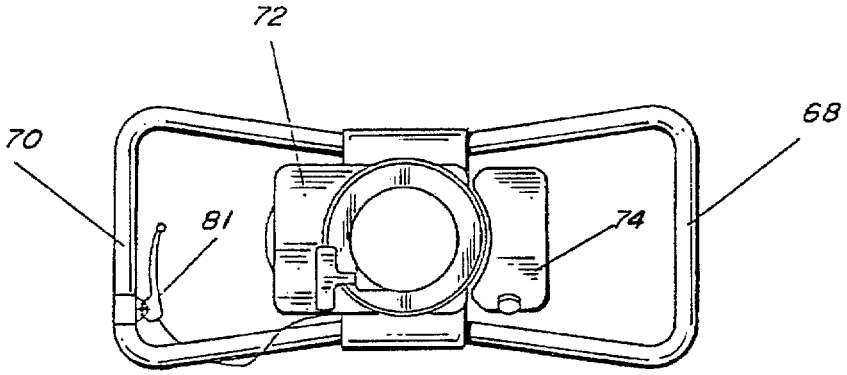
FIG. 2 is a top plan view of an ice auger device in a vertical position.
Figure 3:
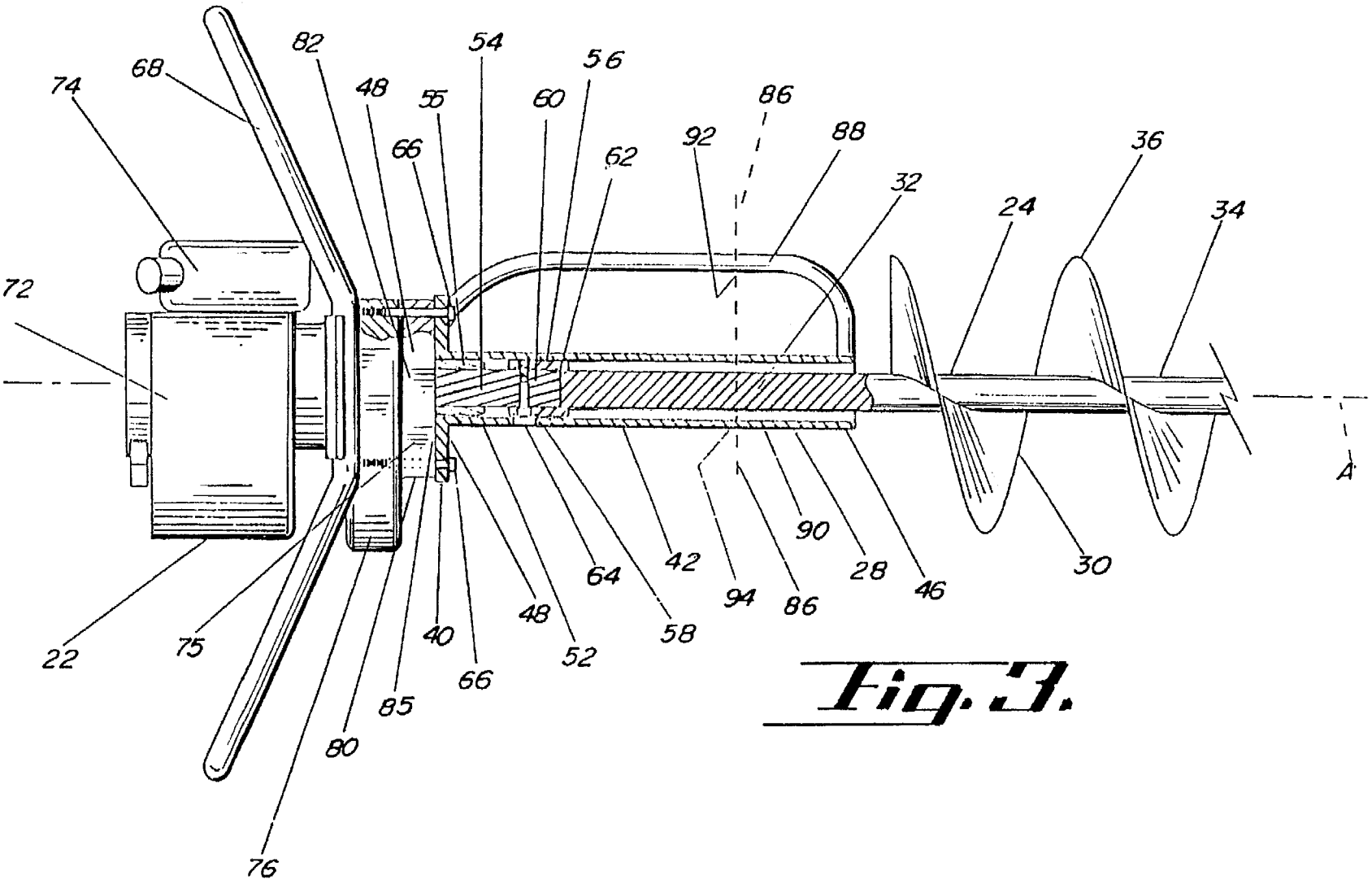
FIG. 3 is a side elevational view of the invention in a horizontal carrying position.

Referring to FIGS. 2 and 3, one embodiment of the invention is shown in a horizontal carrying position and an end view. The end view of FIG. 2 is common to both the prior art device of FIG. 1 and the embodiment of FIG. 3. FIG. 1 is an example of a prior art ice auger device 18 which has a drive unit 22 and a rotatable driven portion 24. The device is depicted as being carried in the typical horizontal manner by grasping the rotatable driven portion 24. The device is generally designated by the numeral 20 and is comprised principally of a drive unit 22, a rotatable driven portion 24 and a guard member 28. The rotatable driven portion 24 is comprised of an auger portion 30 and a shank portion 32 which is driven by the drive unit 22 and rotates about an axis of rotation A. The auger portion has a shaft 34 and a spiral blade 36. The guard member 28 has a flange portion 40, a cylindrical hollow elongate portion 42, a grasping member or handle 44, a distal end 46, and a proximal end 48. The guard member 28 may be formed of cast aluminum or may be formed of steel by conventional fabrication techniques.

The drive unit 22 has an output 52 comprised of a shaft member 54 extending from a hub portion 55. The shaft member 54 connects to the rotatable driven portion 24 by way of a coupling 56. The coupling 56 is held together by way of a bolt or pin 58 which secures together the male portion 60 and the female portion 62. The pin or bolt 58 is accessible through the hollow elongate portion 42 by way of the aperture 64. The guard member 28 is secured to the drive unit 22 by way of the flange portion 40 with bolts 66. The drive unit 22 also has handles 68, 70 by which the auger may be stabilized and supported during an ice boring operation.

The drive unit 22 has a conventional internal combustion engine 72 with a gas tank 74, a lower housing unit 75, a gear box 76, a centrifugal clutch portion 80, and a throttle lever 81. The centrifugal clutch portion 80 includes a casing 82 enclosing said clutch and providing an attachment surface 85 for the flange portion 40 of the guard member 54.

The ice auger has a balance zone which is generally a planar region designated by the numeral 86 which extends through the handle 44 and the hollow elongate portion 42 of the guard member 28. The guard member has grasping portions 88, 90 by which the apparatus may be grasped by one hand and picked up and carried with the hand positioned at the balance zone 86. The balance zone 86 intersects the elongate portion 42 and the handle 44 at balance points 92, 94. The balance points 92, 94 are the areas at which the device may be suspended or held in a balanced horizontal position.

Figure 4:
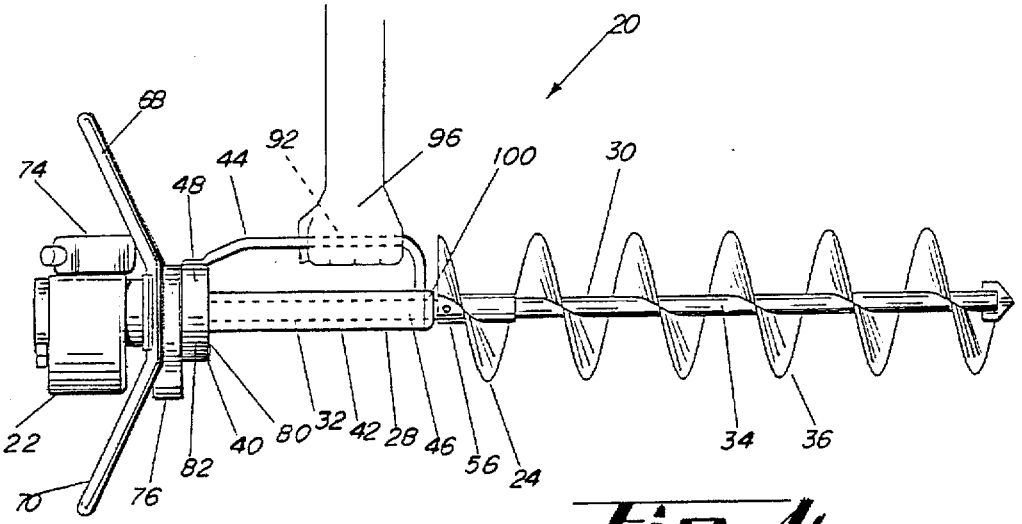
FIG. 4 is a elevational view of a further embodiment of the invention.

Referring to FIG. 4, a hand 96 is shown grasping an embodiment of the invention at the balance point 92 on the handle 44. The embodiment of FIG. 3 shows the coupling 56 positioned at the distal end of the guard member 28 and elongate portion 42. In this embodiment the apparatus has a bearing portion 100 at the distal end of the guard member 28 to provide further support for the shank portion 32. As can be seen in this particular embodiment, breaking the device down at the coupling 56 will result in an overall more compact package for storage or shipment.

In the embodiment of FIG. 4, the guard member 28 is integral with the casing 82 of the centrifugal clutch portion 80. Notably, the centrifugal clutch portion 80 may also be integral with the gear box 76.

Figure 5:
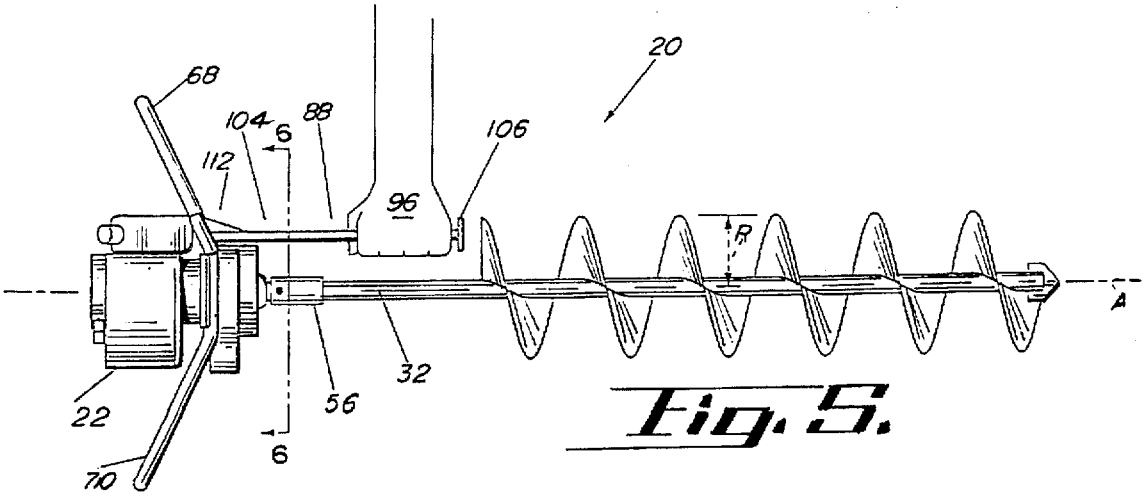
FIG. 5 is a side elevational view of a further embodiment of the invention.

Referring to FIG. 5, a further embodiment of the invention is shown. In this particular configuration the grasping portion 88 is part of a grasping member 104 configured as a bar extending from the drive unit 22 by way of attachment to the handle 68. Said grasping member 104 with the grasping portion 88 may be attached by conventional means such as bolting or welding. Such a configuration is suitable for retro-fitting or existing ice augers or being furnished as standard equipment with the ice auger when sold. The grasping member 104 has a stop 106 to prevent the hand from sliding off the end of the bar when the device is being carried. This configuration has the grasping portion 88 on the grasping member 104 extending a radial distance from the shank portion less than the diameter D of the auger portion whereby the grasping member 104 will not affect the boring depth capability of the device 20.

Figure 6:
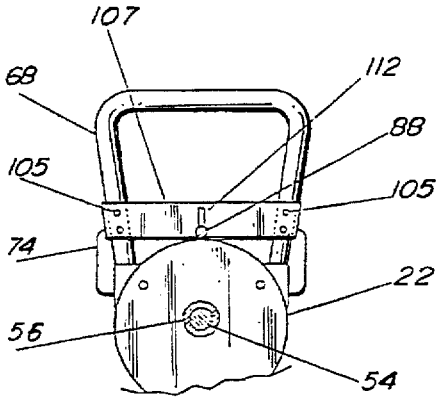
FIG. 6 is a partial sectional view taken at line 6—6 of FIG. 5.

FIG. 6 is a partial sectional view taken at line 6—6 of FIG. 5 showing one means of attachment of the gasping member 104 to the handle 68. A plate 107 is suitably shaped to follow the contours of the handle 68 and is attached by way of bolts 109 that may extend through the handle 68 to secure the plate 107 and the welded grasping member 104 to the handle 68. A structural support 112 braces the grasping member 104 to the plate 107.

Figure 7:
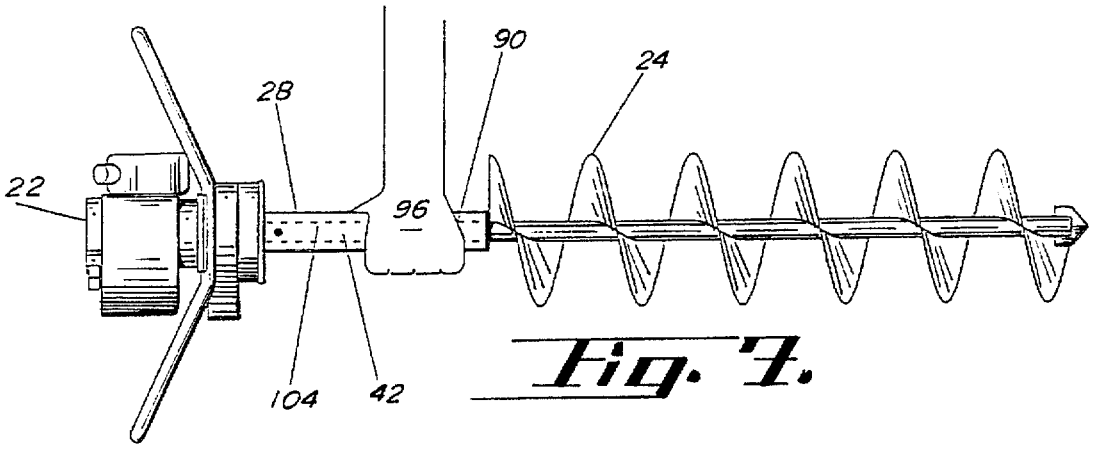
FIG. 7 is a side elevational view of a further embodiment of the invention.
Figure 8:
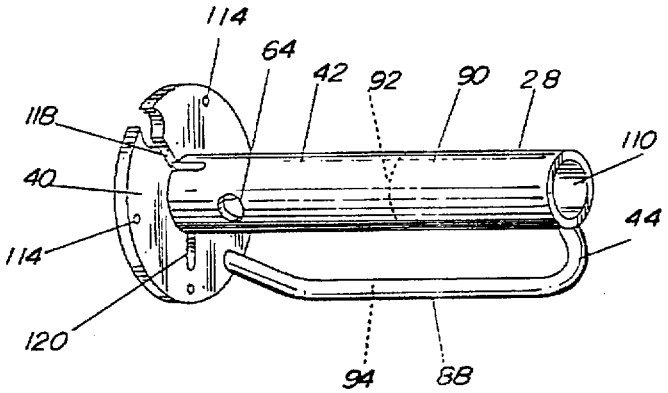
FIG. 8 is a detail perspective view of a guard member suitable for retro-fitting existing ice augers.

Referring to FIG. 7, a further embodiment of the invention is shown which has a guard member 28 which has a hollow cylindrical portion 42 that extends around the shank portion, not shown in this view. The guard member 28 in this embodiment does not have the separate handle 44 such as shown in FIGS. 2 and 3. Rather, the elongate portion 42 is a gasping member 104 with the grasping portion 90. The guard member 28 is fixed to the drive unit 22 and thereby does not rotate with the rotatable driven portion FIG. 8 is a detail drawing of a guard member 28 which includes a hollow elongate portion 42, a flange portion 40, and a handle 44. The hollow cylindrical portion 42 has an open interior 110 within which the shank portion, not shown in this view, extends when in place on the apparatus. Holes 114 are utilized for attaching the guard member 28 to the drive unit 22. This particular guard member is suitable for retro-fitting on existing unguarded ice augers. Slots 118, 120 extend in the flange portion 40 into the hollow elongate portion 42 for receiving structural fins which may be present on the lower casing of non-guarded ice augers. The aperture 64 is utilized for accessing a pin or bolt, not shown in this view, which secures the coupling connecting the rotatable driven portion to the output 52 of the drive unit 22. This particular configuration of the guard member 28 has a grasping portion 88 on the handle 44 and a grasping portion 90 on the hollow elongate portion 42, either of which are nonrotatable and permit carrying the ice auger at the balance points on the guard member 28. The balance points are indicated by the dashed lines with the numerals 92, 94.

The embodiments shown in FIGS. 3, 4, 5, and 7 to the prior art ice auger device shown in FIG. 1 illustrates a principle advantage of the invention in its different embodiments. That advantage being the capability of carrying the ice auger in the natural horizontal position without the necessity of grasping a driven or rotatable part. Moreover, in the embodiments of FIGS. 3, 4, 7, and 8 the principle advantage of enclosing and guarding the shank portion 32 and the coupling 56 is illustrated.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An ice auger apparatus for manual drilling of holes in ice, the apparatus comprised of:

a drive unit comprised of an intermediate combustion engine, the drive unit having a rotatable output, a rotatable portion comprised of an auger portion with a blade extending outwardly a radial distance and a shank portion, the rotatable portion connected to the output and rotatable by said drive unit, the shank portion positioned intermediate the auger portion and the drive unit, the apparatus having a vertical operating position and a horizontal carrying position, the apparatus further comprised of an elongate grasping member non-rotatably fixed to and extending from the drive unit along the shank portion, the grasping member having a grasping portion positioned intermediate the drive unit and the blade of the auger portion and within the radial distance, the apparatus having a balance point extending thru the shank portion and the grasping portion when the apparatus is in the horizontal position, whereby when the grasping portion is grasped the apparatus may be carried in a substantially balanced horizontal position by a single hand without grasping the rotatable portion.

2. The ice auger apparatus of claim 1, wherein the rotatable portion further comprises a shank portion coupled to the output and connected to the auger portion, and wherein the grasping portion is rigid, and tubular, and extends around the shank portion.

3. The ice auger apparatus of claim 2, wherein the grasping member comprises a rigid hollow elongate portion through which the shank portion extends.

4. The ice auger apparatus of claim 3, wherein the rotatable portion is connected to the output at a coupling and wherein the coupling is positioned within the hollow elongate portion.

5. The ice auger apparatus of claim 1 wherein the grasping member is further comprised of a guard member having a distal end and a proximal end, the guard member comprised of a rigid guard portion extending from the drive unit and extending substantially around the shank portion, the proximal end fixed to the drive unit, the grasping portion extending outwardly from the guard member.

6. The ice auger apparatus of claim 2, wherein the guard member has a proximal end connected to the drive unit, a distal end opposite the proximal end, and wherein the grasping portion extends from the distal end to the proximal end of the guard member.

7. The ice auger apparatus of claim 4 further comprising a bearing member attached to the guard member, the bearing member engaging the rotatable portion.

8. The ice auger apparatus of claim 7, wherein the guard member has a distal end and the bearing member is positioned at the distal end of the guard portion.

9. The ice auger apparatus of claim 2, wherein the drive unit has a handle and the apparatus is further comprised of a bar member extending from said handle, the bar member including the grasping portion.

10. An ice auger apparatus for drilling of holes in ice, the auger comprised of:

(a) a drive unit with a handle for maintaining the apparatus in a vertical position when drilling holes, the handle extending laterally from the drive unit when the apparatus is in the vertical position;

(b) a rotatable driven portion having an axis and comprised of a shank portion and an auger portion, the shank portion connected to and extending from the drive unit, the shank portion rotatable by said drive unit, the auger portion connected to the shank portion and rotatable with said shank portion; and (c) a guard member non-rotatably attached to the drive unit and extending axially along and around the shank portion, the guard member having an elongate grasping portion extending axially along the shank portion for carrying the apparatus in a horizontal position.

11. The ice auger apparatus of claim 10, wherein the guard member is comprised of a rigid hollow guard portion through which the shank portion extends.

12. The ice auger of claim 10 further comprising a guard portion extending from the drive unit and extending around the shank portion, wherein the rotatable driven portion has a coupling for connecting and disconnecting said driven portion, and wherein said coupling is positioned inside the hollow guard portion.

13. The ice auger of claim 12, wherein the coupling is secured together by a connecting member and wherein the hollow guard portion has an opening for accessing said connecting member.

14. The ice auger apparatus of claim 10, further comprising a guard portion extending from the drive unit and extending around the shank portion, wherein the hollow guard portion has a proximal end and a distal end, wherein the rotatable driven portion has a separable coupling for attaching and removing said driven portion, and wherein said coupling is positioned beyond the distal end of the guard portion.

15. The ice auger apparatus of claim 14 further comprising a bearing member positioned in the distal end of the hollow guard portion, said bearing member engaged with the rotatable driven portion.

16. The ice auger apparatus of claim 10, wherein the apparatus has a balance point when in the horizontal position and wherein said balance point is on the grasping portion whereby the apparatus may be carried in a balanced horizonal position by grasping the grasping portion.

17. The ice auger apparatus of claim 16 further comprising a handle extending substantially parallel to the shank portion and wherein the grasping portion is on said handle.

18. A grasping member for an ice auger, the ice auger having a vertical operating position and a substantially horizontal carrying position, the ice auger comprised of a drive unit with a rotating output, a rotatable driven portion extending downwardly from the drive unit, the driven portion comprised of a shank portion and an auger portion, the shank portion connected to the drive unit output and rotatable by said drive unit, an auger portion connected to the shank portion and rotatable with said shank portion, the grasping member connectable to the drive unit, and extending downwardly therefrom, the grasping member having a grasping portion grippable with a hand when in the carrying position, the ice auger with the grasping member having a balance point positioned on the grasping portion.

19. The grasping member of claim 18, wherein the drive unit has a lower housing portion and the grasping member is bolted to said lower housing portion.

20. The grasping member of claim 17, wherein the grasping member is comprised of a flange portion for attachment to the lower housing portion, and a hollow cylindrical portion attached to the flange, the cylindrical portion configured to extend around and guard the shank portion.

21. A grasping member for carrying ice augers in a horizontal carrying position, the ice auger having a drive unit with an engine, a shank portion connected to and rotatable by the drive unit, an auger portion with a blade connected to the shank portion, the ice auger having an axis of rotation about which the shank portion and auger portion rotate, and an elongate grasping member non-rotatably connected to the drive unit and extending in an axial direction therefrom; the grasping member positioned intermediate the blade and the drive unit.

22. The grasping member of claim 21, wherein the grasping member has a grasping portion wherein the blade extends out a distance radially from said axis, and wherein the grasping portion is positioned intermediate the shank and said distance.

* * * * *